US005941625A

United States Patent [19]

Morand

[11] Patent Number: 5,941,625

[45] Date of Patent: Aug. 24, 1999

[54] SPRING CLIP FOR A RECESSED LIGHT FIXTURE ASSEMBLY

[75] Inventor: Michel Morand, Montreal, Canada

[73] Assignee: Bazz Inc., Canada

[21] Appl. No.: 08/989,060

[22] Filed: Dec. 11, 1997

[51] Int. Cl.[6] ..... F21S 1/02

[52] U.S. Cl. ..... 362/148; 362/365; 362/368; 362/374; 248/343

[58] Field of Search ..... 362/147, 148, 362/364, 365, 368, 374, 440, 444, 445; 248/343

[56] References Cited

U.S. PATENT DOCUMENTS

| | | | |
|---|---|---|---|
| 1,589,760 | 6/1926 | Kuen | 362/374 |
| 2,965,348 | 12/1960 | Gerstel et al. | 362/150 |
| 3,308,288 | 3/1967 | Ades | 362/150 |
| 3,370,165 | 2/1968 | Chan | 362/364 |
| 3,375,368 | 3/1968 | Dorsky | 362/365 |
| 3,885,147 | 5/1975 | Chacon | 362/408 |
| 4,088,293 | 5/1978 | Delmore | 248/500 |
| 4,250,540 | 2/1981 | Kristofek | 362/368 |
| 4,293,895 | 10/1981 | Kristofek | 362/147 |
| 4,419,717 | 12/1983 | Price et al. | 362/148 |
| 4,431,151 | 2/1984 | Schonasky | 248/27.1 |
| 4,566,057 | 1/1986 | Druffel | 362/374 |
| 4,593,344 | 6/1986 | Basile | 362/374 |
| 4,739,460 | 4/1988 | Kelsall | 362/365 |
| 5,068,772 | 11/1991 | Shapiro | 362/365 |
| 5,077,650 | 12/1991 | Cestari | 362/365 |
| 5,122,944 | 6/1992 | Webb | 362/365 |
| 5,264,994 | 11/1993 | Choi | 362/148 |

*Primary Examiner*—Alan Cariaso
*Attorney, Agent, or Firm*—Quarles & Brady

[57] ABSTRACT

A spring clip for securing a light fitting into a light fixture housing and for securing the light fixture housing to a ceiling structure is formed of two leg sections. A first leg section has a tongue portion to contactingly engage the light fitting. The spring clip extends through a slot in the light fixture housing extending outside thereof to engage the ceiling structure.

17 Claims, 3 Drawing Sheets

SPRING CLIP FOR A RECESSED LIGHT FIXTURE ASSEMBLY

FIELD OF THE INVENTION

The present invention refers generally to recessed ceiling lighting fixtures and, more particularly, it relates to an improved spring clip for holding a light fitting into a light fixture and for securing the light fixture to a ceiling structure.

BACKGROUND OF THE INVENTION

Various types of light fixture supporting clips are known. For example, in U.S. Pat. No. 4,739,460 issued Apr. 19, 1988 to Kelsall, there is described a recessed remodelling light fixture adapted for mounting in an opening within a ceiling. A pair of snap spring clips of special configuration are utilized for holding the cylindrical fixture housing within the ceiling. The clips are disposed in elongated slots which are vertically aligned within the wall of the housing. During installation, the spring clips are rotated outwardly through the slots to bear against the upper sub-ceiling surface for securely retaining securely the housing within the ceiling.

In this U.S. patent, nor in the prior art uncovered in a search directed to the present subject matter, a spring clip is disclosed which serves the dual purpose of securing the fixture housing to the ceiling structure as well as securing a light fitting or trimming to the light fixture.

STATEMENT OF THE INVENTION

It is therefore an object of the present invention to provide a spring clip which, while securing a light fixture housing to a ceiling structure, also serves to allow easy and rapid insertion and removal of a light fitting or trimming to the light fixture housing.

This is achieved by providing a spring clip which, in accordance with the present invention, comprises an elongated body that defines a first leg section and a second leg section bent relative to the first leg section; the first leg section has inner and outer surfaces and an integral resilient tongue portion that extends outwardly from the outer surface. The tongue portion has, at a free end thereof, a light fitting contacting protuberance. While the first leg section has, at a free end thereof, a light fixture engaging flange, the second leg section consists of a first portion contiguous with and inclined relative to the first leg section and a second portion bent relative to the first portion and has a free end adapted for contacting the ceiling structure.

The present invention also relates to a recessed light fixture assembly which is adapted to be mounted in an opening of a ceiling structure. It comprises:

a generally cylindrical light fixture housing having a wall and an opened end; the wall having slot means therein; the wall, at the free end, displaying a peripheral flange adapted for contacting the ceiling structure;

spring clip means engaged in the slot means; the spring clip means having an elongated bent body defining a first leg section extending in the housing and a second leg section extending outside the housing; the first leg section having inner and outer surfaces and a resilient integral tongue portion extending outwardly from the outer surface; the tongue portion having, at a free end thereof, first engaging means; and light fitting means adapted for mounting in the housing; the fitting means defining an annular body having a generally cylindrical wall and second engaging means thereon;

whereby insertion of the light fitting means in the housing causes the cylindrical wall of the annular body to flex the resilient tongue portion of the spring clip means inwardly allowing the light fitting means to be securely received in the housing as the first and second engaging means inter-engaged; removal of the light fitting means from the housing being achieved by exerting a pulling force thereon causing the tongue portion of the spring clip means to flex to disengage the inter-engaged first and second engaging means from one another.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 1:
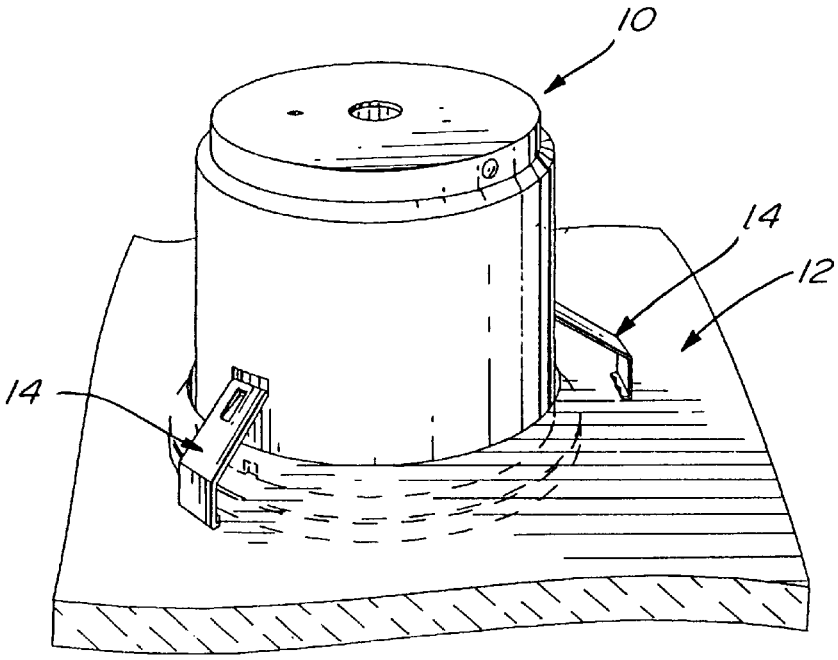
FIG. 1 is a perspective view showing a light fixture housing mounted to a ceiling structure by means of clips made in accordance with the present invention.
Figure 5:
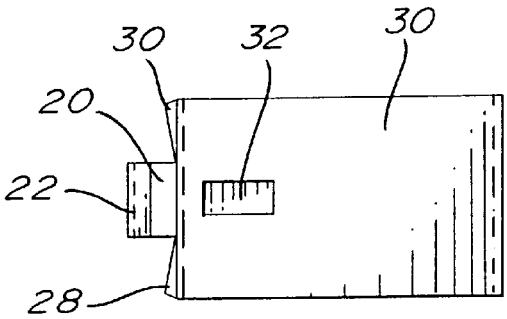
FIG. 5 is a top plan view thereof.
Figure 3:
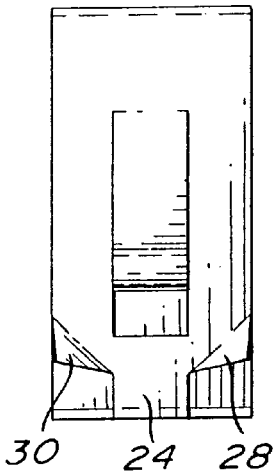
FIG. 3 is a front elevation view thereof.
Figure 2:
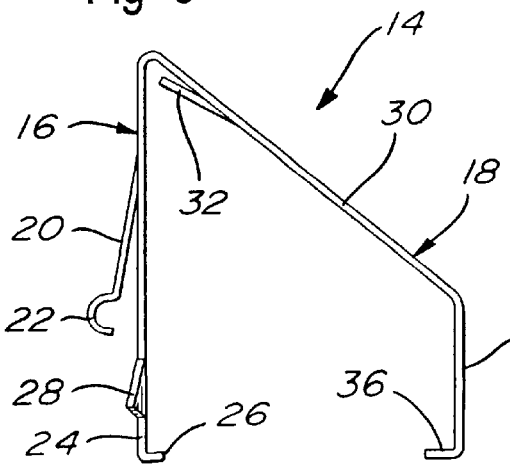
FIG. 2 is a side elevation view of the clip.
Figure 4:
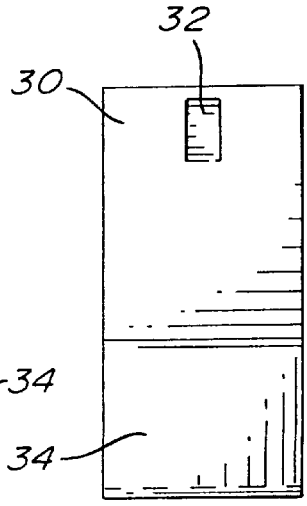
FIG. 4 is a rear elevation view thereof.

Referring to FIG. 1, there is shown a light fixture housing 10 being mounted to the subceiling surface 12 of a ceiling structure by means of a series of clips 14.

Referring more particularly to FIGS. 2–5, each clip 14 is formed of a first leg section 16 and of a bent second leg section 18. The first leg section 16 extends vertically and displays, in the center thereof, an outwardly projecting punched-out tongue portion 20 having, at its free end, a semicircular protuberance 22. The lower end of the leg section 16 has a L-shaped restricted portion 24 including a horizontally extending edge 26. Adjacent the restricted lower portion 24 is a pair of opposite frontwardly projecting triangular shaped wing extensions 28 and 30, the function of which will be described further hereinbelow.

The second leg portion 18 comprises an inclined first portion 30, the upper end of which displays a punched-out projection 32. The second leg section 18 also includes a vertically extending lower portion 34 with a horizontally extending edge 36.

The clip is preferably constructed of a resilient material such as spring or sheet steel. This enables the clip to be formed in a simple bending and stamping operation. The resiliency of the material further enables the tongue portion to be flexed and the second leg section to also flex relative to the first leg section.

Figure 6:
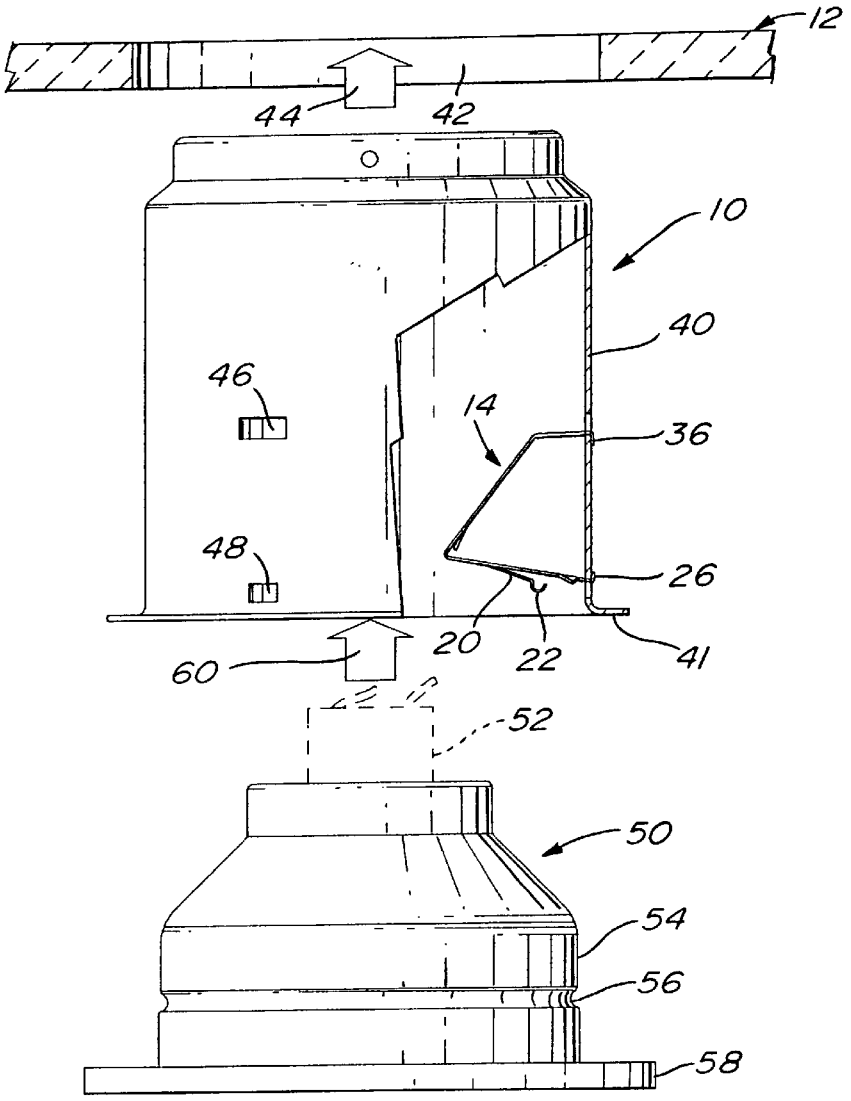
FIG. 6 is an exploded view showing the components of the light fixture assembly to be mounted to a ceiling structure.

Referring to FIG. 6, the light fixture housing 10 has a generally cylindrical wall 40 with an opened end surrounded by an annular flange 41. An opening 42 is made in a ceiling 12 so as to receive the housing as indicated by arrow 44. The cylindrical wall 40 of the light fixture housing 10 has a pair of vertically spaced slots 46 and 48; there are preferably three sets of these pairs of slots on the cylindrical wall of a housing. As illustrated in FIG. 6, the edges 26 and 36 of the clip 14 extend through the slots 48 and 46, respectively, bearing against the outer face of the cylindrical wall.

FIG. 6 also shows a light fitting or trimming, generally denoted 50, in which is installed a light bulb 52. The light fitting has a generally cylindrical outer wall 54 in which is provided a rounded groove 56. The lower end of the light fitting is opened and has an annular flange 58 which, as can be seen in FIG. 7, covers the flange 41 of the light fixture housing when the components are assembled.

Figure 7:
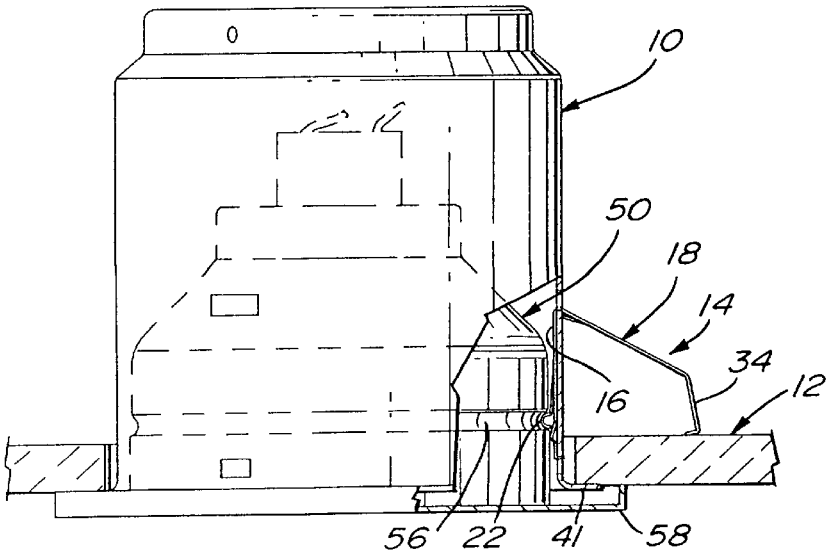
FIG. 7 is an elevational view showing the assembly of the components of FIG. 6.

To assemble the light fixture assembly, the light fitting 50 is inserted, as indicated by arrow 60, into the cylindrical housing forcing the spring clips to pivot and to adopt the position shown in FIG. 7. The leg section 16 of the clip bears against the inner surface of the cylindrical housing while the leg section 18 extends outside the housing with its lower portion 34 resting against the subceiling surface of the ceiling structure. During sliding entry, the tongue portion 20 of the spring clip contacts the wall 54 of the light fitting until its protuberance 22 engages the peripheral groove 56 of the light fitting.

Figure 8:
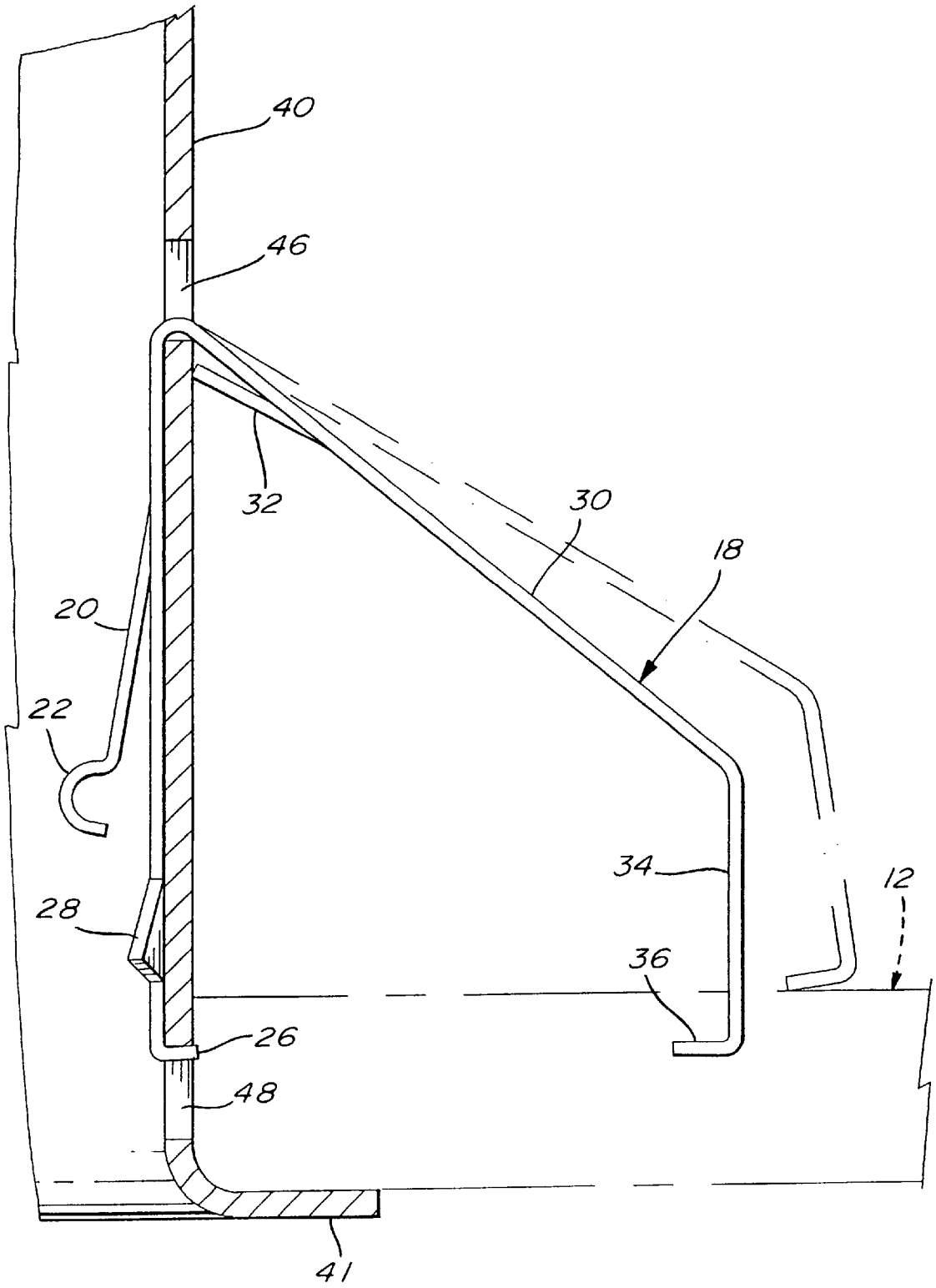
FIG. 8 is an enlarged cross sectional view of the lower right corner shown in FIG. 7, the light fitting having been removed.

FIG. 8 shows the possibility of having various thicknesses of ceiling 12.

The punched-out portion 32 of the inclined portion 30 of the second leg section 18 bears against the outer surface of the cylindrical wall acting as a stopper preventing the clip from being dislodged during removal. Also, FIG. 8 shows that, whenever it is desired to remove the spring clip from the housing, a tool is inserted behind the wings 28 or 30 thus freeing the lower portion edge 26 from its engagement in the slot 48; thereafter, the second leg portion may be easily retracted through the slot 46.

Although the invention has been described above with respect with one specific form, it will be evident to a person skilled in the art that it may be modified and refined in various ways. It is therefore wished to have it understood that the present invention should not be limited in scope, except by the terms of the following claims.

I claim:

1. A spring clip for securing a light fitting into a light fixture and for securing the light fixture to a ceiling structure comprising an elongated body defining a first leg section and a second leg section bent relative to said first leg section;

said first leg section having inner and outer surfaces and an integral resilient tongue portion extending outwardly from said outer surface;

said tongue portion having, at a free end thereof, a light fitting contacting protuberance;

said first leg section having, at a free end thereof, a light fixture-engaging flange;

said second leg section defining a first portion contiguous with and inclined relative to said first leg section and a second portion bent relative to said first portion and having a free end adapted for contacting said ceiling structure.

2. A spring clip as defined in claim 1, wherein said body is metallic and said integral resilient integral tongue portion is a punched-out section of said first leg section.

3. A spring clip as defined in claim 1, wherein said fixture-engaging flange has a restricted width relative to that of said body.

4. A spring clip as defined in claim 3, wherein said first leg section includes opposite outwardly bent wing portions connecting said flange to said first leg section.

5. A spring clip as defined in claim 1, wherein said first includes portion of said second leg portion a stopper projection extending outwardly from an inner surface of said inclined portion.

6. A spring clip as defined in claim 5, wherein said body is metallic and wherein said stopper projection is a punched-out section of said first inclined portion.

7. A spring clip as defined in claim 1, wherein the free end of the second portion of said second leg section defines a horizontal flange adapted to contact the ceiling structure.

8. A recessed light fixture assembly adapted to be mounted in an opening of a ceiling structure, comprising:

a generally cylindrical light fixture housing having a wall and an opened free end; said wall having slot means therein; said wall, at said opened free end, displaying a peripheral flange adapted for contacting said ceiling structure;

spring clip means engaged in said slot means; said spring clip means having an elongated bent body defining a first leg section extending in said housing and a second leg section extending outside said housing; said first leg section having inner and outer surfaces and a resilient integral tongue portion extending outwardly from said outer surface; said tongue portion having, at a free end thereof, first engaging means; and light fitting means adapted for mounting in said housing; said fitting means defining an annular body having a generally cylindrical wall and second engaging means thereon;

whereby insertion of said light fitting means in said housing causes said cylindrical wall of said annular body to flex said resilient tongue portion of said spring clip means inwardly allowing said light fitting means to be securely received in said housing as said first and second engaging means inter-engaged; removal of said light fitting means from said housing being achieved by exerting a pulling force thereon causing the tongue portions of said spring clips means to flex to disengage the inter-engaged first and second engaging means from one another.

9. A recessed light fixture assembly as defined in claim 8, wherein said cylindrical wall of said annular body includes a annular flange adapted for covering said peripheral flange of said cylindrical housing.

10. A recessed light fixture assembly as defined in claim 8, wherein said slot means consist of a pair of vertically spaced openings in said cylindrical wall of said housing; one of said openings being disposed adjacent said annular flange and a second of said openings being disposed inwardly on said cylindrical wall of said housing; said elongated bent body extending through said second opening.

11. A recessed light fixture as defined in claim 8, wherein said first engaging means consist of a rounded protuberance and said second engaging means consist of a peripheral rounded groove on said cylindrical wall of said light fitting means.

12. A recessed light fixture assembly as defined in claim 8, wherein said elongated bent body is metallic and said integral resilient integral tongue portion is a punched-out section of said first leg section.

13. A recessed light fixture assembly as defined in claim 8, wherein said first leg section has, at a free end thereof, a horizontal gripping flange having a width smaller than that of the remaining part of said first leg section.

14. A recessed light fixture assembly as defined in claim 13, wherein said first leg section further includes opposite outwardly bent wing portions connecting said flange to said remaining part.

15. A recessed light fixture assembly as defined in claim 8 wherein said second leg portion includes an inclined portion having a stopper projection extending on an inner surface thereof.

16. A recessed light fixture assembly as defined in claim 15, wherein said elongated bent body is metallic and wherein said stopper projection is a punched-out section of said inclined portion.

17. A recessed light fixture assembly as defined in claim 16, wherein a free end of said second leg section defines a horizontal flange adapted to contact the ceiling structure.

* * * * *